United States Patent [19]

Oplinger

[11] 4,202,586

[45] May 13, 1980

[54] STACKABLE FURNITURE MODULES HAVING REPLACEABLE PANELS

[76] Inventor: Terry R. Oplinger, 34177 Whittaker, Mt. Clemens, Mich. 48043

[21] Appl. No.: 946,577

[22] Filed: Sep. 28, 1978

[51] Int. Cl.[2] ..... A47B 87/00

[52] U.S. Cl. ..... 312/107; 312/111; 312/257 R; 312/223; 211/188

[58] Field of Search ..... 312/107, 108, 111, 223, 312/257 R, 257 A, 257 SK, 198; 211/126, 186, 188

[56] References Cited

U.S. PATENT DOCUMENTS

| | | | |
|---|---|---|---|
| 129,688 | 7/1872 | Smith | 312/107 |
| 909,951 | 1/1909 | Schriefer | 312/107 |
| 2,506,844 | 5/1950 | Smith | 312/107 |
| 3,012,835 | 12/1961 | Anderson et al. | 312/257 R |
| 3,432,216 | 3/1969 | Yang | 312/111 |
| 3,672,741 | 6/1972 | Clark | 312/223 |
| 3,847,460 | 11/1974 | Weidt | 312/111 |
| 3,926,487 | 12/1975 | Reyes | 312/223 |
| 4,055,373 | 10/1977 | Andresen et al. | 312/198 |
| 4,103,782 | 8/1978 | Mayer | 312/107 |
| 4,108,514 | 8/1978 | Zimmerman | 312/107 |

*Primary Examiner*—Victor N. Sakran
*Attorney, Agent, or Firm*—Basile and Weintraub

[57] ABSTRACT

Stackable furniture modules having replaceable front panels for custom mounting of audio and other home electronic equipment are disclosed. The modules are nestable one upon the other in a secure manner. Removeable panels allow custom mounting of various electronic components and the interchange of components by the replacement of inexpensive panels. An open module is provided to allow the stacking of components above a record changing mechanism.

3 Claims, 10 Drawing Figures

FIG-3
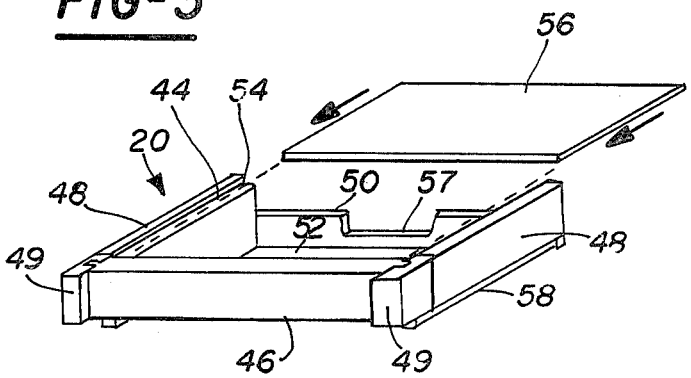
FIG-5
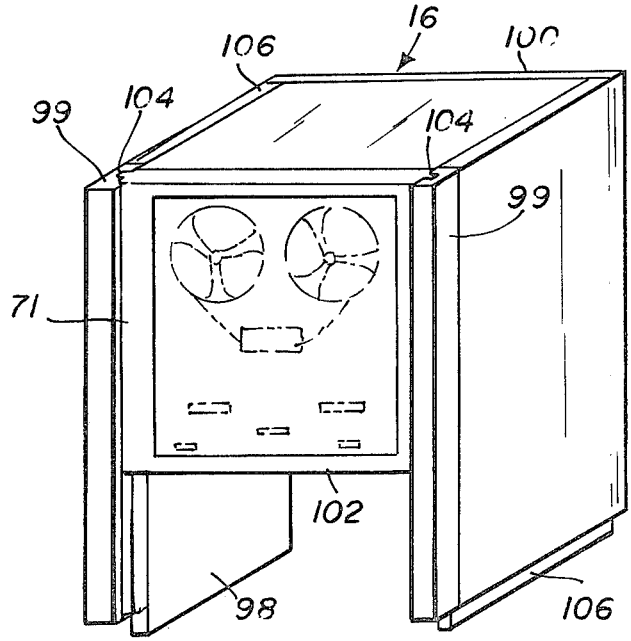
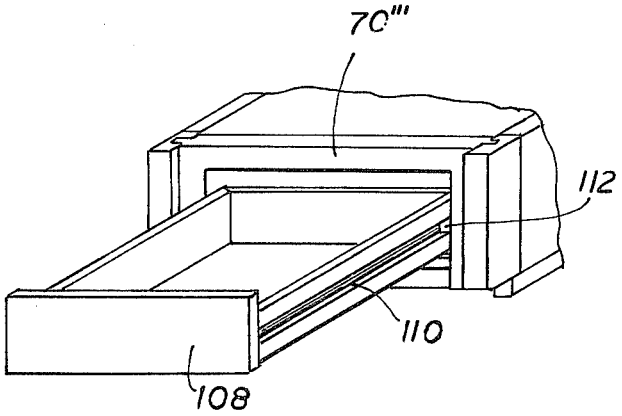
FIG-6

FIG-4
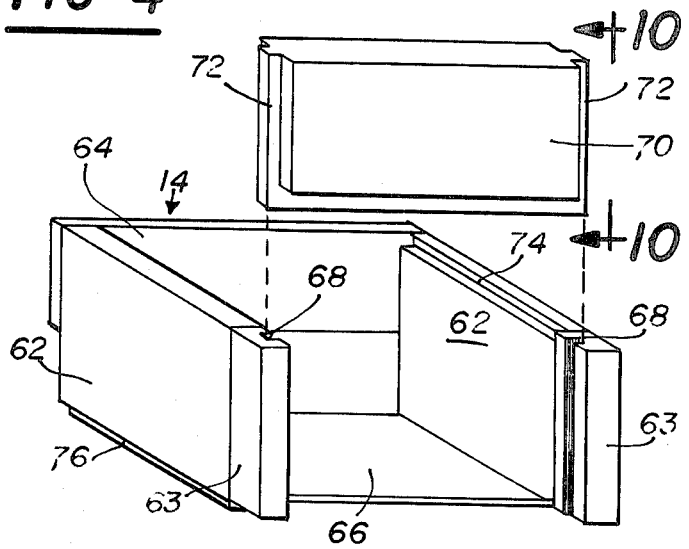
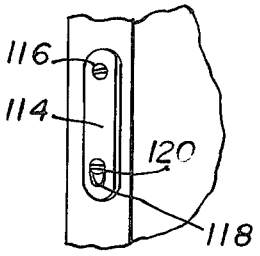
FIG-9
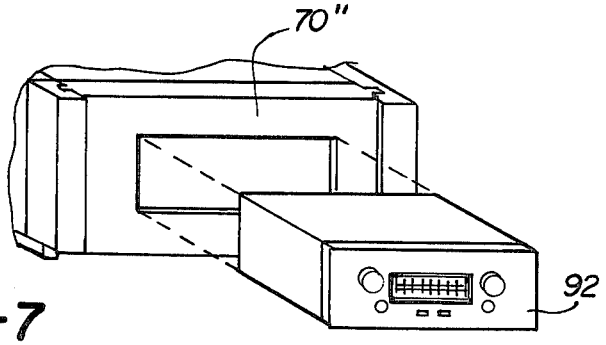
FIG-7
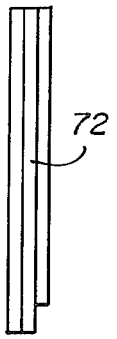
FIG-10
FIG-8
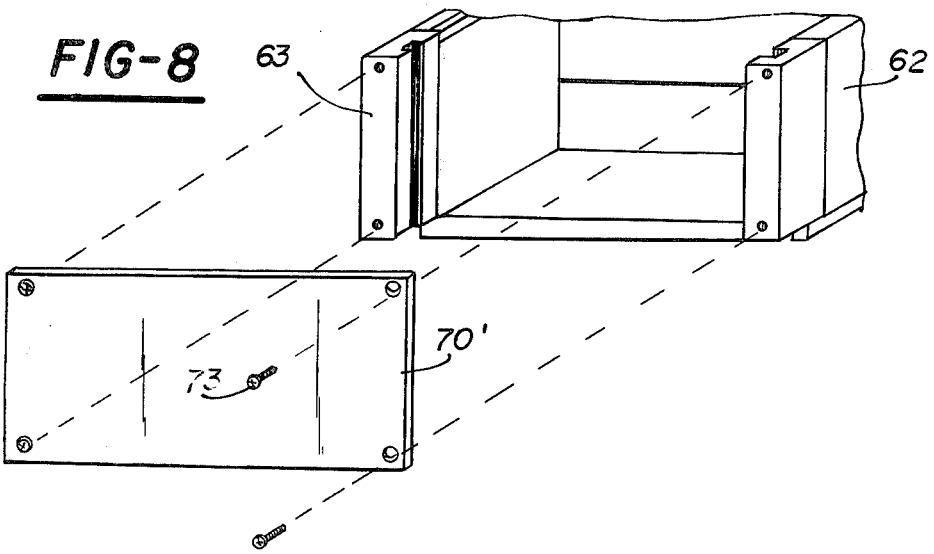

STACKABLE FURNITURE MODULES HAVING REPLACEABLE PANELS

BACKGROUND OF THE INVNETION

I. Field of the Invention

The present invention relates to the field of stackable furniture modules, and in particular to the field of stackable furniture modules having removeable panels therein which can be adapted to mounting various audio and other home electronic equipment in a customized manner.

II. Prior Art Statement

Numerous means for stacking furniture components one upon another are disclosed in the art. One method commonly used to interlock the components is to use a flange projecting upward around the periphery of the top of the lower unit to engage a corresponding groove in the bottom of the upper unit. This method is effective for interlocking the units and keeping them aligned one to the other. This method is disclosed in U.S. Pat. Nos. 671,147; 909,951; and 2,506,844. While effective, the above-described interlocking method is expensive. U.S. Pat. No. 129,688 discloses a method of interlocking spool thread cases which interlocks a stack of spool drawers between side members in a manner similar to that used in the instant invention except relative fore and aft movement of the drawer enclosures is prevented by a flange along the top edge of the rear wall of the lower drawer enclosure which engages a matching groove in the bottom edge of the rear wall of the mating upper drawer enclosure. The present invention retains the modules on four sides and no fore and aft relative movement of the units is possible. The present invention provides removeable panels that can be custom altered to receive various electronic audio components. The replacement of an obsolete component with one of new design requiring a new or different cut-out can be accomplished without affecting the appearance of the stackable modules by using a replaceable panel which is easily changed at little expense. Modules of varying height are provided to accommodate different sizes of electronic components.

Other objects, advantages, and applications of the present invention will become apparent to those skilled in the art of stackable furniture modules when the accompanying description of one example of the best mode contemplated for practicing the invention is read in conjunction with the accompanying drawing.

BRIEF DESCRIPTION OF THE DRAWINGS

The description herein makes reference to the accompanying drawings wherein like reference numbers refer to like parts throughout the several views and wherein:

FIG. 3 illustrates a perspective view of a record player module;

FIG. 4 illustrates an intermediate module having a sliding front panel;

FIG. 5 illustrates an open module having clearance for stacking modules above the record player module;

FIG. 6 illustrates a drawer module;

FIG. 7 illustrates the front mounting of an electronic component to a sliding front panel;

FIG. 8 illustrates a removeable front panel that is attached to the sides of the intermediate module with screws.

FIG. 9 illustrates the use of a fish plate for affixing modules securely and preventing their separation therefore assuring the integrity of the assembled modules as one unit;

FIG. 10 illustrates a side view of the sliding front panel in FIG. 4.

DESCRIPTION OF THE PREFERRED EMBODIMENT

Figure 1:
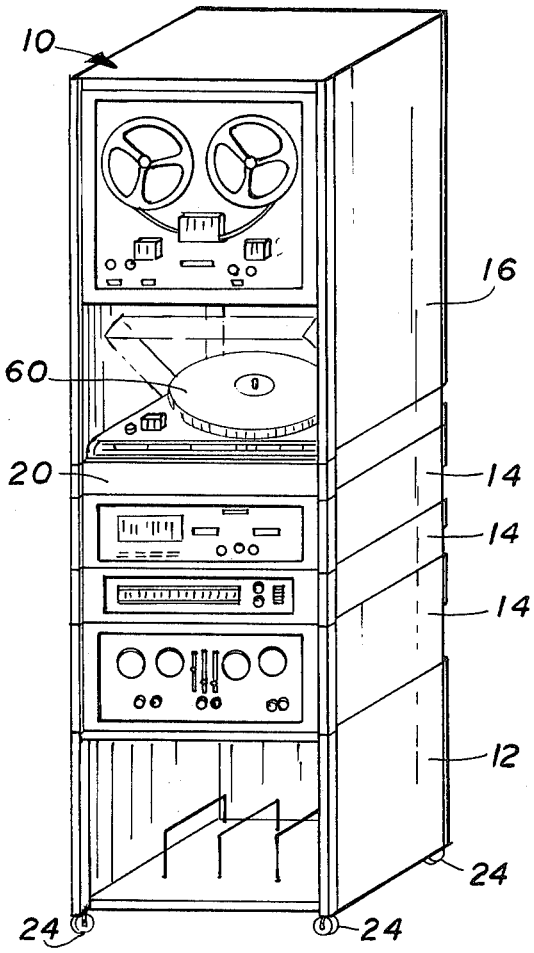
FIG. 1 illustrates a perspective view of the preferred embodiment of the present invention with the various modules assembled and ready for use.

Referring now to the drawing wherein there is illustrated in FIG. 1 an embodiment of the present invention at 10 comprising a base module 12 which is supported on the floor by means of casters 24. The casters 24 are optional, they can be eliminated and the base module 12 rested directly on the floor if desired. The base module 12 nestingly received at its top an intermediate module 14 which is dimensioned to nest atop the base module 12. The intermediate module 14 has a removeable front panel which can be cut-out or customized in a manner to receive various electronic components. The intermediate modules 14 are designed to nestingly receive other intermediate modules in a stackable secure manner. A record player module 20 is nestingly received by the upper intermediate module 14. A record player 60 can be rested atop the top panel of the record player module 20 or the slidable top panel can be cut-out to mount the record player 60 in a custom manner. An open module 16 is mountable atop the record player module 20.

The intermediate modules 14 are interchangeable and can be stacked one upon another in any desired order. The intermediate modules 14 could be stacked on the base module 12 followed by the record player module, and the open module 16 eliminated to produce an assembly having a record player with top access. The versatility of this modular arrangement and the means for securely stacking the modules in any desired order will be explained in greater detail hereinafter.

Figure 2:
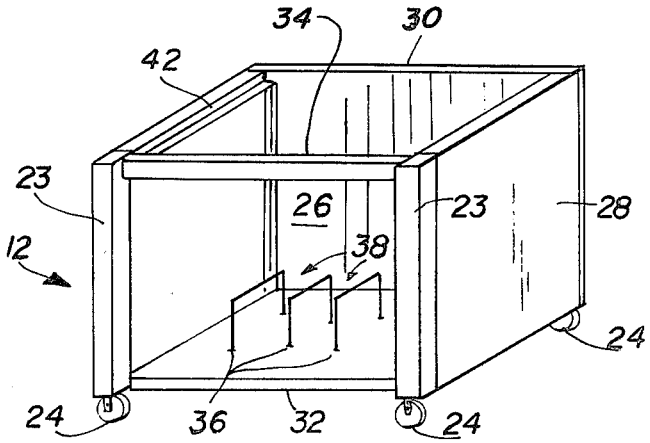
FIG. 2 illustrates a perspective view of the lower record storage module.

Referring now to FIG. 2 wherein there is illustrated a perspective view of the base module 12 adapted for record storage. The base module 12 has an open front 26 and closed side 28, back 30, bottom members 32. A pair of vertical corner members 23 are affixed to the front ends of the side members 28. A transverse support member 34 extends along the top of the front between the corner members 23. A plurality of parallel upstanding spaced apart inverted U-shaped wire members 36 are supported by mating apertures in the bottom member 32 providing a plurality of openings 38 for storing record albums. A plurality of casters 24 provide a means for moving the assembly along the floor, or the casters can be removed and the base module supported directly on the floor. In another embodiment of the lower module, a drawer having closed front, side, back and bottom members and an open top is fitted to slide into the front of the lower module.

In a third embodiment of the lower module a pair of doors are hinged from the verticle corner members 23 to provide a closed front to store records or to use the space to store refreshments.

The lower module has an open top with a first upper recess 42 along the inner surface of the top edge removing half the thickness from the sides. The recess extends below the top edge a distance to define a nesting dimension, the purpose of which will be discribed more fully hereinafter.

FIG. 3 illustrates a record player module 20 comprising closed front 46, side 48, rear 50, and bottom walls 52. A pair of vertical corner members 49 are affixed to the front ends of the sides 48. A recess 44 is cut along the inner surface of the top edge of the side walls 48 to define the nesting dimension of the base module. A horizontal groove 54 is disposed along the inner surface of the side walls 48. The top of the groove 54 is spaced below the bottom of the recess 44 to avoid interference with the nesting dimension. The width and depth of the groove 54 is sufficient to slidingly receive a sliding upper wall 56. The top of the back wall 50 terminates below the lower surface of the upper wall 56, and a recess 57 is cut in the back wall 50 to clear the bottom of a record player mechanism 60 providing clearance for the insertion of the sliding upper wall 56 when the record player 60 is attached thereto. A recess 58 is cut along the outer surface of the bottom edge of the side wall 48 to define a dimension less than the nesting dimension of the base unit to establish the insertable nesting dimension allowing the record player module to be stacked upon any module having the nesting dimension. The vertical corner members 49 extend from the top of the side wall 48 to the upper edge of the recess 58. The sliding upper wall 56 is adaptable to being cut-out to receive a record player mechanism 60.

FIG. 4 illustrates an intermediate module 14 having closed sides 62, partly open back 64, and bottom 66. A pair of vertical corner members 63 are affixed to the front end of the sides 62. A pair of vertical grooves 68 are disposed along the inside of the vertical corner members 63 spaced back from the front edge a distance. A slidable front panel 70 shown also in FIG. 10, has thin vertical projections 72 along its ends to slidingly engage the vertical grooves in the sides. A recess 74 along the inner surface of the top edge of the sides 62 establishes the nesting dimension in the top of the intermediate module. The back 64 is open from the bottom halfway to the top to provide ventilation and access for wires and power connections. A recess 76 along the outer surface of the bottom edge of the sides 62 establishes the insertable nesting dimension in the bottom so that any module having the nesting dimension can nestingly receive an intermediate module. The vertical corner members 63 extend from the top of the side members 62 to the top of the recess 76. The intermediate modules 14 are provided in at least three different heights to allow for electronic components of varying size.

FIG. 7 illustrates another embodiment of a front panel 70 wherein a front panel mounted electronic component 92 is mounted to the panel 70″ which has been cut-out to receive the component 92. It is readily apparent that components can be readily changed from one intermediate module to another by easily changing panels, or a new component requiring new mountings can be added to a stack by preparing a new slidable panel.

FIG. 5 illustrates a perspective view of the open module 16 having closed side walls 98, closed rear wall 100, a closed top, and a closed bottom wall 102. A pair of vertical corner members 99 are affixed to the front end of the side walls 98. The bottom wall 102 is spaced above the bottom edge of the side walls 98 and the back wall 100 providing clearance for a record player dust cover in the up position when the open module 16 is stacked thereabove. A pair of vertical grooves 104 are disposed along the upper portion of the inside front edge of the corner members 99 spaced back from the front edge a distance. The length of the grooves 104 and their dimensions are established to slidingly receive the sliding front panel 71. A recess 106 along the outer surface of the bottom edge of the sides 98 establishes the insertable nesting dimension on the bottom of the open intermediate module to allow it to be nested atop any module having the nesting dimension.

FIG. 6 illustrates another embodiment of the slidable front panel 70 wherein the panel 70‴ has been adapted to receive a drawer 108. Grooves 110 engage guides 112 in the panel to allow smooth operation of the drawer 108. The sliding panel 70‴ is insertable in place of any of the sliding front panels in the intermediate modules 14 or the open module 16.

FIG. 9 illustrates a metal fish plate 114 that is used when in position to prevent the inadvertent vertical separation of the components. The clip comprises a strip of metal 114 having an aperture at its upper end to receive a screw 116. The lower end of the clip has an elongated opening 118 engaging a second screw 120 in the lower component. The spacing between the upper screw 116 and the lower screw 120 can vary somewhat due to normal manufacturing tolerances. The elongated opening 118 is designed to accommodate those normal manufacturing variations.

While FIG. 1 illustrates a preferred embodiment of the stacked modules, any desired arrangement of modules can be used and any combination of slidable front panels can be used to produce a desired combination of electronic equipment and storage drawers.

FIG. 8 illustrates another embodiment of the front panel 70. Panel 70′ is a replaceable front panel that is attached to the corner members 63 using wood screws 73.

Having thus described my invention, what I claim is:

1. Stackable furniture modules having identical size as to width and depth adapted for mounting of electronic components therein comprising:

a lower module supported by casters having an open front, closed side, back, and bottom members, a first pair of vertical corner members affixed to the front end of the side members, a transverse support member across the top of the front extending between first corner members, an open top having a first upper recess along the inner surface of the top edge removing half of the thickness of the side member, defining a nesting dimension, said first recess extending below the top edge a distance, including means in the bottom member of said lower module for defining a record storage space;

an intermediate module having closed sides, bottom, and partially closed back, a second pair of vertical corner members affixed to the front end of the sides, a pair of vertical grooves on the inside edge of the second corner members spaced back from the front edge of the sides, one per second corner member, a slidable front panel having thin vertical projections along both ends to slidingly engage said pair of vertical grooves, a recess along the top inside edge of the panel to nestingly receive the front edge of the bottom member of a nesting unit, a second open top having a second upper recess along the inner surface of the top edge removing half the material from the sides, to equal said nesting dimension, said second upper recess extending below the top edge a distance, a first bottom recess along the outer surface of the bottom of the sides removing material to establish a size slightly less than said nesting dimension defining an insertable nesting dimension permitting the bottom of the intermediate unit to be slidingly nested into the nesting dimension of the lower unit, the recess extending up the side members, a distance less than the depth of said first and second upper recesses, the pair of vertical corner members extending from the top edge of the sides to the beginning of said first bottom recess, establishing said nesting dimension, said slidable front panel adaptable to mounting electronic components in a customized manner;

a record player with closed front, side, and rear walls, and a closed bottom wall, a pair of third vertical corner members affixed to the front edge of the side walls, a third recess cut along the inner surface of the top edge of the side walls to define said nesting dimension, a horizontal groove is disposed along the inner surface of the side walls spaced below the nesting recess to slidingly receive a sliding upper wall, the top edge of the rear wall is spaced below the bottom surface of the sliding upper wall, a portion of the rear wall cut away, and a third bottom recess along the outer surface of the bottom of the side walls extending up the side walls a distance less than the depth of the recess for said nesting dimension, said recess defining an outer dimension for the third bottom recess less than said nesting dimension establishing the insertable nesting dimension to allow the record player module to be slidingly nested atop any unit having said nesting dimension.

2. Stackable furniture modules having identical dimensions as to width and depth as defined in claim 1 further comprising:

an open module stackable upon the record player unit comprising:

closed side, top, and rear walls, a bottom wall spaced above the bottom edge of the walls a distance to provide clearance for the record player when open, fourth pair of vertical corner members affixed to the front end of the sides, a pair of vertical grooves along the inner surface of the corner members spaced back from the front edge running from the bottom wall to an open top to receive a second slidable front panel extending from said top wall to said bottom wall, a fourth bottom recess along the outer surface of the side walls, extending up the walls a distance less than the depth of said nesting dimension establishing the insertable nesting dimension and allowing the open reel unit to be slidingly stackable upon the record player unit, said fourth pair of vertical corner members extending from the upper surface of said top wall to the upper edge of the fourth bottom recess.

3. Stackable furniture modules having identical dimensions as to width and depth as defined in claim 1 wherein:

said slidable front panel has an opening therein to receive a slidable drawer.

* * * * *